US011107407B2

(12) United States Patent
Xu et al.

(10) Patent No.: US 11,107,407 B2
(45) Date of Patent: Aug. 31, 2021

(54) METHOD FOR DRIVING PIXEL CIRCUIT, PIXEL CIRCUIT, AND DISPLAY PANEL

(71) Applicants: HEFEI XINSHENG OPTOELECTRONICS TECHNOLOGY CO., LTD., Hefei (CN); BOE TECHNOLOGY GROUP CO., LTD., Beijing (CN)

(72) Inventors: Haixia Xu, Beijing (CN); Yue Wu, Beijing (CN); Can Yuan, Beijing (CN); Wenchao Bao, Beijing (CN)

(73) Assignees: HEFEI XINSHENG OPTOELECTRONICS TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 14 days.

(21) Appl. No.: 16/620,681

(22) PCT Filed: Dec. 15, 2017

(86) PCT No.: PCT/CN2017/116504
§ 371 (c)(1),
(2) Date: Dec. 9, 2019

(87) PCT Pub. No.: WO2018/227911
PCT Pub. Date: Dec. 20, 2018

(65) Prior Publication Data

US 2021/0142726 A1 May 13, 2021

(30) Foreign Application Priority Data

Jun. 15, 2017 (CN) ..... 201710451096.7

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2310/061* (2013.01); *G09G 2310/08* (2013.01)

(58) Field of Classification Search
CPC .. G09G 3/3258; G09G 3/3266; G09G 3/3275; G09G 2310/08; G09G 2310/061
See application file for complete search history.

(56) References Cited

U.S. PATENT DOCUMENTS

2015/0138179 A1* 5/2015 Park ..... G09G 3/3291 345/212
2015/0187268 A1* 7/2015 Tani ..... G09G 3/3233 345/77

(Continued)

FOREIGN PATENT DOCUMENTS

CN 106409225 A 2/2017
EP 2876634 A1 5/2015

OTHER PUBLICATIONS

European Extended Search Report, Application No. 17913174.3, dated Jan. 21, 2021, 11 pps.

(Continued)

*Primary Examiner* — Roberto W Flores
(74) *Attorney, Agent, or Firm* — Armstrong Teasdale LLP

(57) ABSTRACT

Embodiments of the present disclosure provide a method for driving a pixel circuit, a pixel circuit, and a display panel. In this method, a zero-voltage signal is provided to a data signal terminal. A first ON signal is provided to a first scan signal terminal, a second ON signal is provided to a second scan signal terminal, and a first level data signal or the zero-voltage signal is provided to the data signal terminal.

(Continued)

Next, a decreased data signal, a second level data signal and the zero-voltage signal are provided to the data signal terminal.

15 Claims, 6 Drawing Sheets

(56) References Cited

U.S. PATENT DOCUMENTS

| | | | | |
|---|---|---|---|---|
| 2016/0189617 | A1* | 6/2016 | Park | G09G 5/10 345/690 |
| 2016/0189630 | A1* | 6/2016 | Chang | G09G 3/3233 345/211 |
| 2017/0206839 | A1 | 7/2017 | Wu et al. | |
| 2017/0270850 | A1* | 9/2017 | Pappas | G09G 3/2022 |
| 2018/0254009 | A1* | 9/2018 | Li | G09G 3/3241 |
| 2018/0322829 | A1* | 11/2018 | Xie | G09G 3/3233 |

OTHER PUBLICATIONS

Indian First Examination Report, Application No. 201927050819, dated Jan. 29, 2021, 5 pps.

* cited by examiner

METHOD FOR DRIVING PIXEL CIRCUIT, PIXEL CIRCUIT, AND DISPLAY PANEL

CROSS REFERENCE TO RELATED APPLICATIONS

This patent application is a National Stage Entry of PCT/CN2017/116504 filed on Dec. 15, 2017, which claims the benefit and priority of Chinese Patent Application No. 201710451096.7 filed on Jun. 15, 2017, the disclosures of which are incorporated by reference herein in their entirety as part of the present application.

BACKGROUND

The present disclosure relates to the field of display technologies, and more particularly, to a method for driving a pixel circuit, a pixel circuit, and a display panel.

Organic Light Emitting Diode (OLED) display is one of hotspots in the research field of flat panel display. Compared with liquid crystal display (LCD), the OLED display has the advantages of low energy consumption, low production cost, automatic light emission, wide viewing angle and fast response, etc. At present, in the field of flat panel display such as mobile phones, PDAs, and digital cameras, the OLED display has begun to replace the traditional liquid crystal display (LCD). Pixel circuit design is the core technical content of the OLED display and has important research significance.

BRIEF DESCRIPTION

Embodiments of the present disclosure provide a method for driving a pixel circuit, a pixel circuit, and a display panel.

A first aspect of the present disclosure provides a method for driving a pixel circuit. In this method, a zero-voltage signal is provided to a data signal terminal of the pixel circuit in a first period of time. A first ON signal is provided to a first scan signal terminal of the pixel circuit, a second ON signal is provided to a second scan signal terminal of the pixel circuit, and a first level data signal or the zero-voltage signal is provided to the data signal terminal in a second period of time. The first ON signal is maintained at the first scan signal terminal, the second ON signal is maintained at the second scan signal terminal, and a decreased data signal decreased from the first level data signal is provided to the data signal terminal in a third period of time. A second level data signal is provided to the data signal terminal in a fourth period of time. The zero-voltage signal is provided to the data signal terminal in a fifth period of time.

In some embodiments of the present disclosure, in the first period of time, the first ON signal is provided to the first scan signal terminal, and the second ON signal is provided to the second scan signal terminal.

In some embodiments of the present disclosure, in the first period of time, the first ON signal is provided to the first scan signal terminal and the second ON signal is provided to the second scan signal terminal when or after the zero-voltage signal is provided to the data signal terminal.

In some embodiments of the present disclosure, in the first period of time, an OFF signal is provided to the first scan signal terminal, and an OFF signal is provided to the second scan signal terminal.

In some embodiments of the present disclosure, a value of the first level data signal is less than a value of the second level data signal.

In some embodiments of the present disclosure, the decreased data signal is a stepped-down data signal.

In some embodiments of the present disclosure, the stepped-down data signal is a four-stage stepped-down data signal.

In some embodiments of the present disclosure, in the fourth period of time, the first ON signal and the OFF signal are provided to the first scan signal terminal to charge a sense signal terminal of the pixel circuit, and the second ON signal and the OFF signal are provided to the second scan signal terminal to obtain compensation data for the sense signal terminal.

In some embodiments of the present disclosure, the fourth period of time includes a first sub-period of time, a second sub-period of time, and a third sub-period of time. In the first sub-period of time, the first ON signal is provided to the first scan signal terminal, the second ON signal is provided to the second scan signal terminal, and the second level data signal is provided to the data signal terminal. In the second sub-period of time, the OFF signal is provided to the first scan signal terminal, the second ON signal is provided to the second scan signal terminal, and the second level data signal is provided to the data signal terminal to charge the sense signal terminal. In the third sub-period of time, the OFF signal is provided to the first scan signal terminal, the OFF signal is provided to the second scan signal terminal, and the second level data signal is provided to the data signal terminal, to obtain the compensation data for the sense signal terminal.

In some embodiments of the present disclosure, in the fifth period of time, the first ON signal is provided to the first scan signal terminal, the second ON signal is provided to the second scan signal terminal, and a gain data signal is provided to the data signal terminal after the zero-voltage signal is provided.

In some embodiments of the present disclosure, the gain data signal is obtained by multiplying the compensation data by a preset coefficient.

In some embodiments of the present disclosure, the method further includes providing the first ON signal to the first scan signal terminal, providing the OFF signal to the second scan signal terminal, and providing a compensated data signal to the data signal terminal in a light emission period of time.

In some embodiments of the present disclosure, the first period of time, the second period of time, the third period of time, the fourth period of time, and the fifth period of time constitute a blank period of time. The first period of time accounts for 3% of the blank period of time, the second period of time accounts for 10% of the blank period of time, the third period of time accounts for 5% of the blank period of time, the fourth period of time accounts for 79% of the blank period of time, and the fifth period of time accounts for 3% of the blank period of time.

A second aspect of the present disclosure provides a pixel circuit driven by the above drive method. The pixel circuit includes a drive transistor, a first transistor, a second transistor, a capacitor, and a light emitting device. A gate of the first transistor is coupled to the first scan signal terminal, a first electrode of the first transistor is coupled to the data signal terminal, and a second electrode of the first transistor is coupled to a gate of the drive transistor. A gate of the second transistor is coupled to the second scan signal terminal, a first electrode of the second transistor is coupled to the sense signal terminal, and a second electrode of the second transistor is coupled to a first node. A first electrode of the drive transistor is coupled to a high voltage level signal terminal, and a second electrode of the drive transistor is coupled to the first node. An end of the light emitting device is coupled to the first node, and another end of the light emitting device is grounded. The capacitor is coupled between the first node and the gate of the drive transistor.

In some embodiments of the present disclosure, the first transistor is an N-type transistor, and the first ON signal is a high level signal. The first transistor is a P-type transistor, and the first ON signal is a low level signal.

In some embodiments of the present disclosure, the second transistor is an N-type transistor, and the second ON signal is a high level signal. The second transistor is a P-type transistor, and the second ON signal is a low level signal.

A third aspect of the present disclosure provides a display panel. The display panel includes the above pixel circuit provided by the embodiments of the present disclosure.

DETAILED DESCRIPTION

To make technical solutions and advantages of the embodiments of the present disclosure clearer, the technical solutions in the embodiments of the present disclosure will be described clearly and completely below, in conjunction with the accompanying drawings. Apparently, the described embodiments are merely some but not all of the embodiments of the present disclosure. All other embodiments obtained by those of ordinary skill in the art based on the described embodiments without creative efforts shall fall within the protection scope of the present disclosure.

Hereinafter, unless otherwise stated, the expression "Component A being coupled to Component B" means that the Component A is directly coupled to the Component B or is indirectly coupled to the Component B through one or more other components.

As used herein, the singular forms "a", "the" and "said" may be intended to include the plural forms as well, unless the context clearly indicates otherwise.

As used herein, the terms "comprising" and "including" specify the presence of the features, integers, steps, operations, elements, and/or components, but do not preclude the presence or addition of one or more other features, integers, steps, operations, elements, components, and/or groups thereof.

Figure 1:
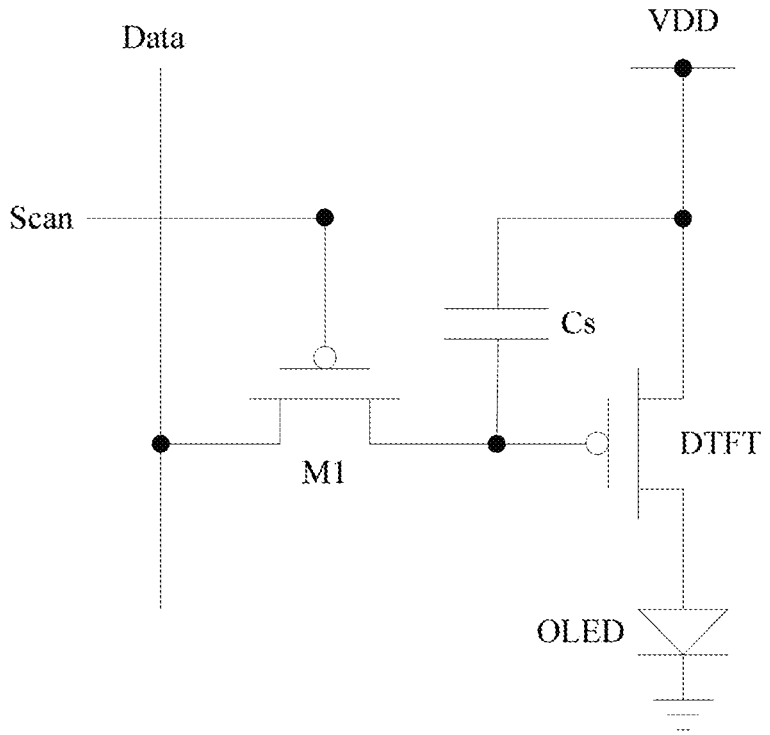
FIG. 1 illustrates a schematic structural diagram of an exemplary pixel circuit which can implement a method for driving a pixel circuit according to an embodiment of the present disclosure.

Unlike an LCD that controls brightness using voltage, an OLED is driven by current and controls light emission brightness according to magnitude of the current. For example, in an existing 2T1C pixel circuit, as shown in FIG. 1, the circuit includes a drive transistor DTFT, a first transistor M1, a storage capacitor Cs, and an OLED. The first transistor M1 is configured to control on and off of the drive transistor DTFT according to a scan signal Scan and a data signal Data. The drive transistor DTFT is configured to control the magnitude of the current flowing through the OLED. When the OLED emits light, according to a saturation current formula of the drive transistor DTFT: $I=K(VGS-Vth)^2=K(VData-VDD-Vth)^2$, the magnitude of the current of the drive transistor DTFT is determined by a difference value between a voltage VData of the data signal Data and a voltage VDD of a direct current signal VDD. Since the direct current signal VDD is a fixed signal, a major factor determining the magnitude of the current of the drive transistor DTFT is the voltage VData of the data signal Data.

The light emission brightness of the OLED is quite sensitive to changes in its drive current. The drive transistors DTFT cannot be made completely consistent in the fabrication process, and threshold voltages Vth of the drive transistors DTFT in the pixel circuit may be varied due to fabrication procedure and device aging as well as temperature variation in the operation. Therefore, variation of the current flowing through each pixel OLED causes uneven display brightness in an entire image, thereby having a negative effect on the display effect of the entire image.

The negative effect of the variation of the threshold voltage of the drive transistor in the pixel circuit on the light emission brightness of the light emitting device may be eliminated by way of external compensation. Specifically, in the display process, a portion of the blank period of time is arranged between the light emission period of time to perform data compensation calculation, and the calculated compensation value is used for the next frame display. As shown in. 2A and 2B, the circuit is added with an external compensation acquisition function. Compensation data for the OLED can be obtained by adding, in the pixel circuit, a second transistor M2 connected between the OLED and a sense signal terminal Sense.

Figure 2A:
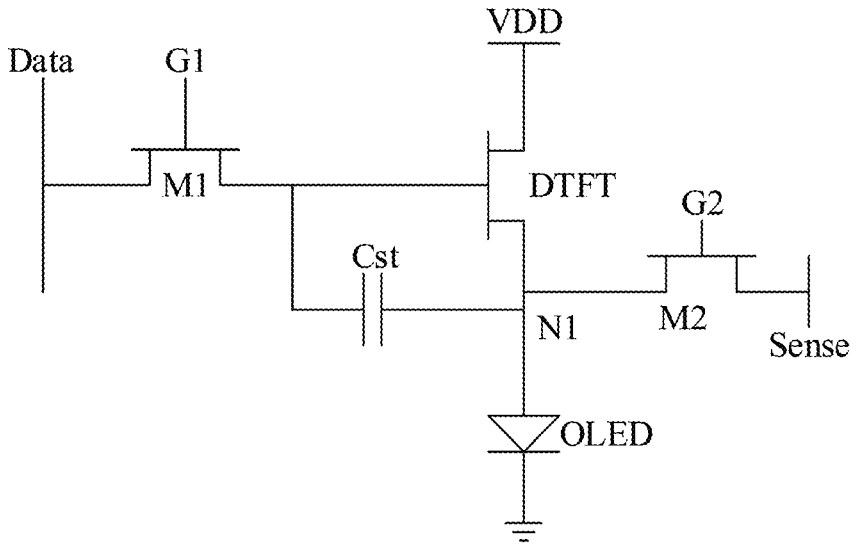
FIGS. 2A and 2B illustrate schematic structural diagrams of two exemplary pixel circuits which can implement a method for driving a pixel circuit according to an embodiment of the present disclosure.
Figure 2B:
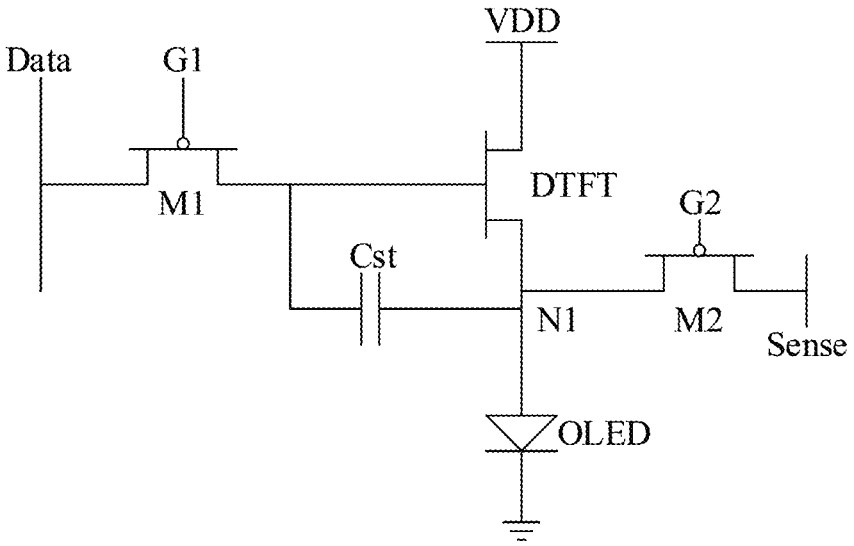

As shown in FIGS. 2A and 2B, the pixel circuit having an external compensation function includes a drive transistor DTFT, a first transistor M1, a second transistor M2, a capacitor Cst, and an OLED. A gate of the first transistor M1 is coupled to a first scan signal terminal G1, a first electrode of the first transistor M1 is coupled to a data signal terminal Data, and a second electrode of the first transistor M1 is coupled to a gate of the drive transistor DTFT. A gate of the second transistor M2 is coupled to a second scan signal terminal G2, a first electrode of the second transistor M2 is coupled to the sense signal terminal Sense, and a second electrode of the second transistor M2 is coupled to a first node N1. A first electrode of the drive transistor DTFT is coupled to a high voltage level signal terminal VDD, and a second electrode of the drive transistor DTFT is coupled to the first node N1. An end of the organic light emitting diode (OLED) is coupled to the first node N1, and another end of the OLED is grounded. The capacitor Cst is coupled between the first node N1 and the gate of the drive transistor DTFT.

In the above pixel circuit, as shown in FIG. 2A, the first transistor M1 may be an N-type transistor, and a first ON signal may be correspondingly a high level signal. Alternatively, as shown in FIG. 2B, the first transistor M1 may be a P-type transistor, and the first ON signal may be correspondingly a low level signal.

In addition, in the above pixel circuit, as shown in FIG. 2A, the second transistor M2 may be an N-type transistor, and a second ON signal may be correspondingly a high level signal. Alternatively, as shown in FIG. 2B, the second transistor M2 may be a P-type transistor, and the second ON signal may be correspondingly a low level signal.

It is to be noted that first electrodes and second electrodes of transistors in the above pixel circuit represent sources and drains, and the sources and the drains of these transistors are interchangeable and are not specifically distinguished.

Figure 3:
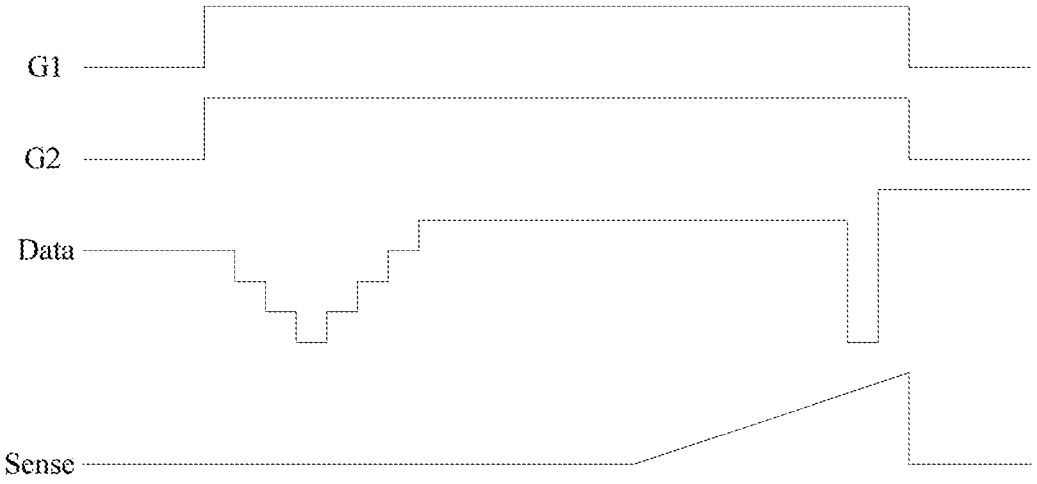
FIG. 3 illustrates an exemplary signal timing diagram for the pixel circuit as shown in FIG. 2A.

FIG. 3 illustrates an exemplary signal timing diagram in the blank period of time which may be implemented by the pixel circuit as shown in FIG. 2A. As compensating with the signal sequences in FIG. 3, due to the data coupling effect of the data signal terminal and the hysteresis effect of the drive transistor, a difference may be caused to an ADC value of the sense signal Sense when switching images (patterns). Therefore, horizontal stripes may appear on the display screen, which may have a negative effect on the normal display.

Figure 4A:
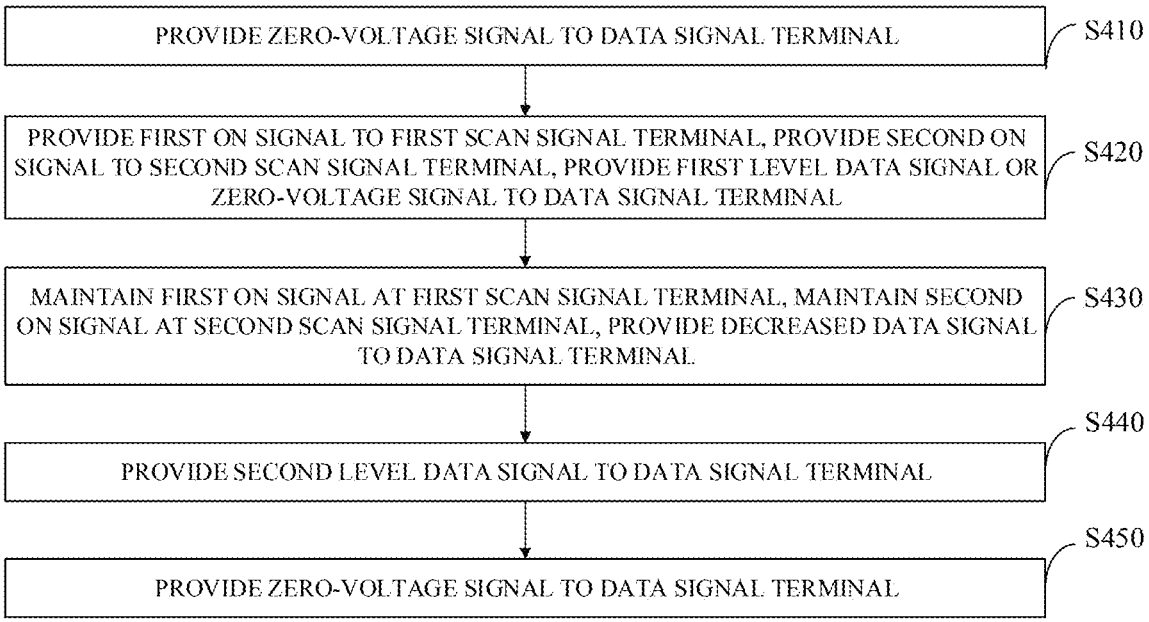
FIGS. 4A and 4B respectively illustrate schematic flowcharts of methods for driving a pixel circuit according to an embodiment of the present disclosure.
Figure 5A:
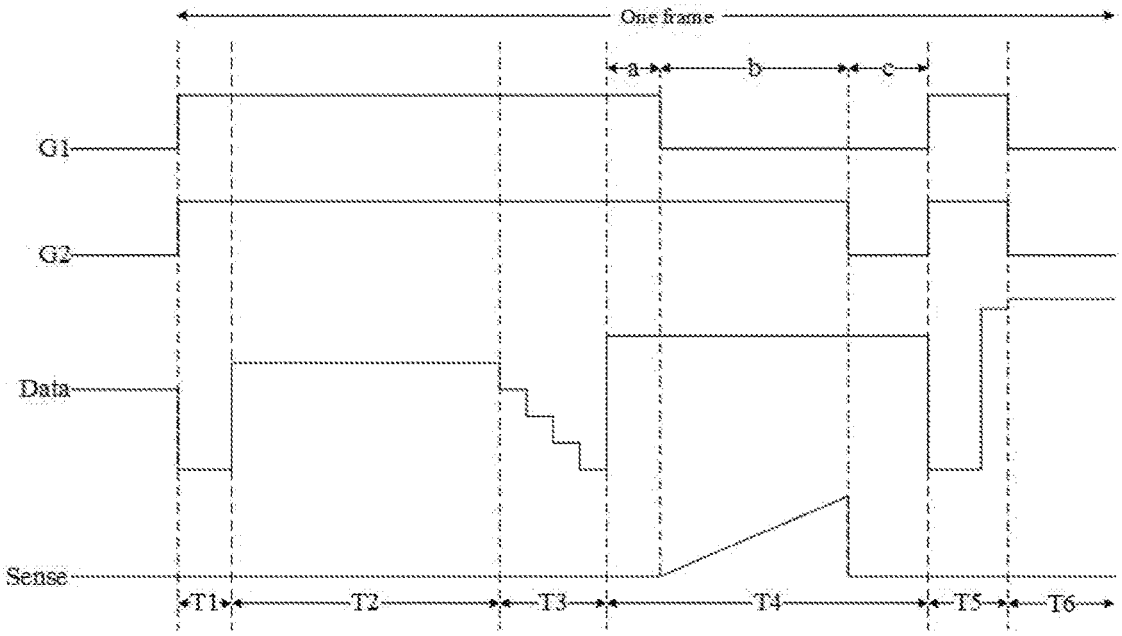
FIGS. 5A-5F schematically illustrate exemplary signal timing diagrams using the method for driving a pixel circuit according to an embodiment of the present disclosure, respectively.

FIG. 4A illustrates a method for driving a pixel circuit according to an embodiment of the present disclosure. The method may be used in the pixel circuit as shown in, for example, FIG. 1, FIG. 2A, and FIG. 2B. For convenience of description, each frame of display time can be assigned into a blank period of time (T1-T5) and a light emission period of time T6, as shown in FIG. 5A. Furthermore, the blank period of time may be sequentially assigned into a first period of time T1, a second period of time T2, a third period of time T3, a fourth period of time T4, and a fifth period of time T5. Referring to FIG. 4A, the driving method may include following steps.

In Step S410, in the first period of time, a zero-voltage signal is provided to the data signal terminal of the pixel circuit.

In Step S420, in the second period of time, the first ON signal is provided to the first scan signal terminal of the pixel circuit, the second ON signal is provided to the second scan signal terminal of the pixel circuit, and a first level data signal or the zero-voltage signal is provided to the data signal terminal.

In Step S430, in the third period of time, the first ON signal is maintained at the first scan signal terminal, the second ON signal is maintained at the second scan signal terminal, and a decreased data signal is provided to the data signal terminal. The decreased data signal is decreased from the first level data signal.

In Step S440, in the fourth period of time, a second level data signal is provided to the data signal terminal.

In Step S450, in the fifth period of time, the zero-voltage signal is provided to the data signal terminal.

In addition, a light emission period of time may also be included in this method. In Step S460, a data signal is provided to the data signal terminal in the light emission period of time.

Figure 4B:
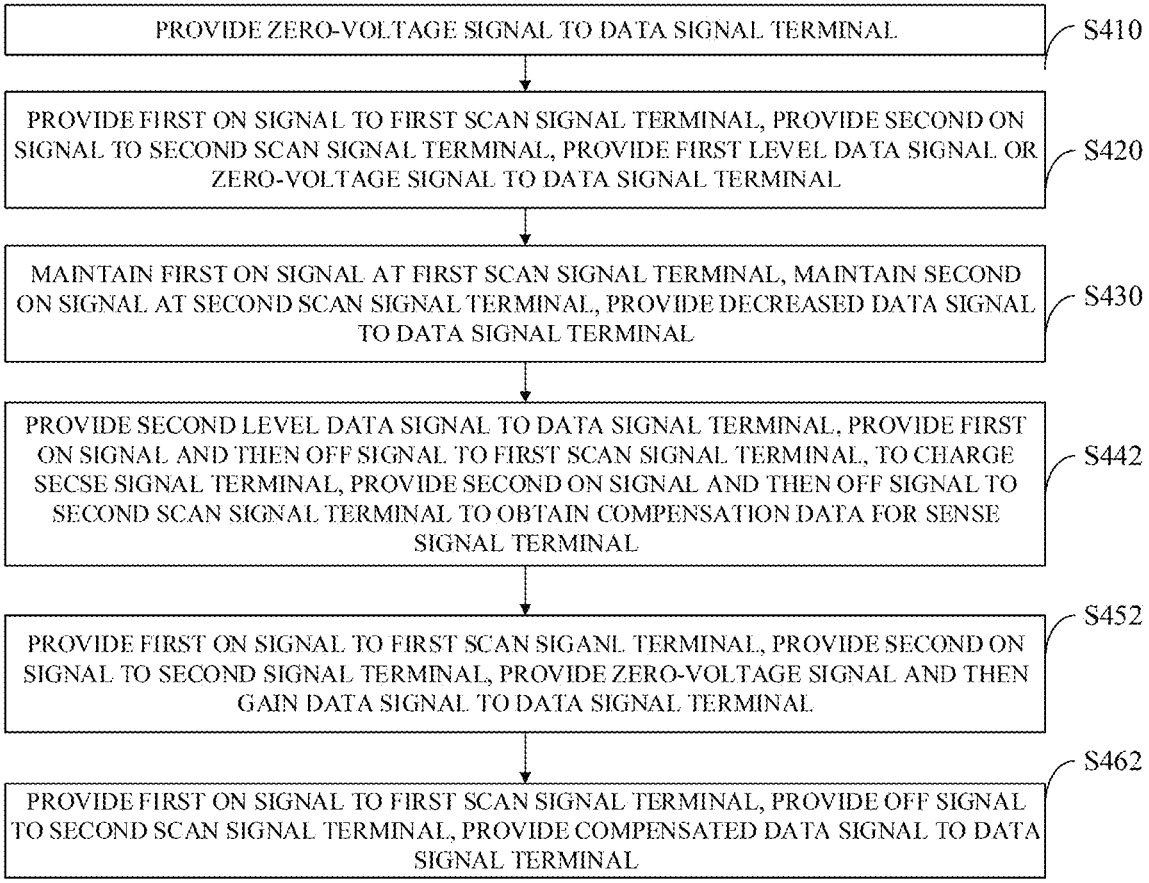

FIG. 4B illustrates a method for driving a pixel circuit according to another embodiment of the present disclosure. This method may be applied to a pixel circuit with a compensation function, as shown in FIGS. 2A and 2B.

In this embodiment, Steps S410, S420, and S430 have been described with reference to FIG. 4A, and thus detailed descriptions thereof are omitted herein.

In Step S442, in the fourth period of time, the second level data signal is provided to the data signal terminal. First, the first ON signal is provided to the first scan signal terminal, and then an OFF signal is provided to the first scan signal terminal, to charge the sense signal terminal of the pixel circuit. Furthermore, the second ON signal is first provided to the second scan signal terminal, and then the OFF signal is provided to the second scan signal terminal, to obtain the compensation data for the sense signal terminal.

In Step S452, in the fifth period of time, the first ON signal is provided to the first scan signal terminal, the second ON signal is provided to the second scan signal terminal, and a gain data signal is provided to the data signal terminal after the zero-voltage signal is provided.

In Step S462, in the light emission period of time, the first ON signal is provided to the first scan signal terminal, the OFF signal is provided to the second scan signal terminal, and a compensated data signal is provided to the data signal terminal. The compensated data signal is obtained by compensating with the compensation data acquired according to the fourth period of time of the previous frame.

Specifically, in the above pixel circuit provided by the embodiments of the present disclosure, in the blank period of time, in order to eliminate the effect of parasitic capacitance on the gate voltage of the drive transistor at the moment when the first transistor and the second transistor are enabled, the zero-voltage signal is first provided to the data signal terminal. Next, the first level data signal of a certain duration or the zero-voltage signal is provided to the data signal terminal to eliminate the hysteresis effect of the drive transistor in the process from OFF to ON using a biasing algorithm. Then, the decreased data signal is provided to the data signal terminal to eliminate the effect of data coupling or the like. Next, in the process of acquiring the compensation data, the second level data signal is maintained at the data signal terminal, the sense signal terminal is charged after the first transistor is disabled, and then the compensation data for the sense signal terminal are further acquired. Finally, a gain data signal is provided to the data signal terminal to eliminate the scan dark lines, thereby solving the problem of leaving horizontal stripes when patterns are switched.

Each period of time in the above driving method according to the embodiments of the present disclosure will be described in detail below with reference to the signal timing diagrams as shown in FIGS. 5A-5F and the pixel circuit as shown in FIG. 2A.

In specific practice, in the above driving method according to the embodiments of the present disclosure, the first period of time T1 is arranged to eliminate the negative effect of the parasitic capacitance on the drive transistor DTFT. Specifically, the first ON signal is provided to the first scan signal terminal G1 to change the first transistor M1 from an OFF state to an ON state. The second ON signal is provided to the second scan signal terminal G2 to change the second transistor M2 from an OFF state to an ON state. At the instant when the first transistor M1 and the second transistor M2 are switched from OFF to ON, the gate voltage of the drive transistor DTFT is affected by the action of the parasitic capacitance. This effect may be eliminated by providing the zero-voltage signal to the data signal terminal Data, such that the zero-voltage signal is written into the gate of the drive transistor DTFT, thereby ensuring the OFF state of the drive transistor DTFT at this moment.

Further, in the above driving method provided by the embodiments of the present disclosure, in the first period of time T1, the sequence of providing signals to the first scan signal terminal G1, the second scan signal terminal G2, and the data signal terminal Data may be implemented in several manners as follows.

Figure 5B:
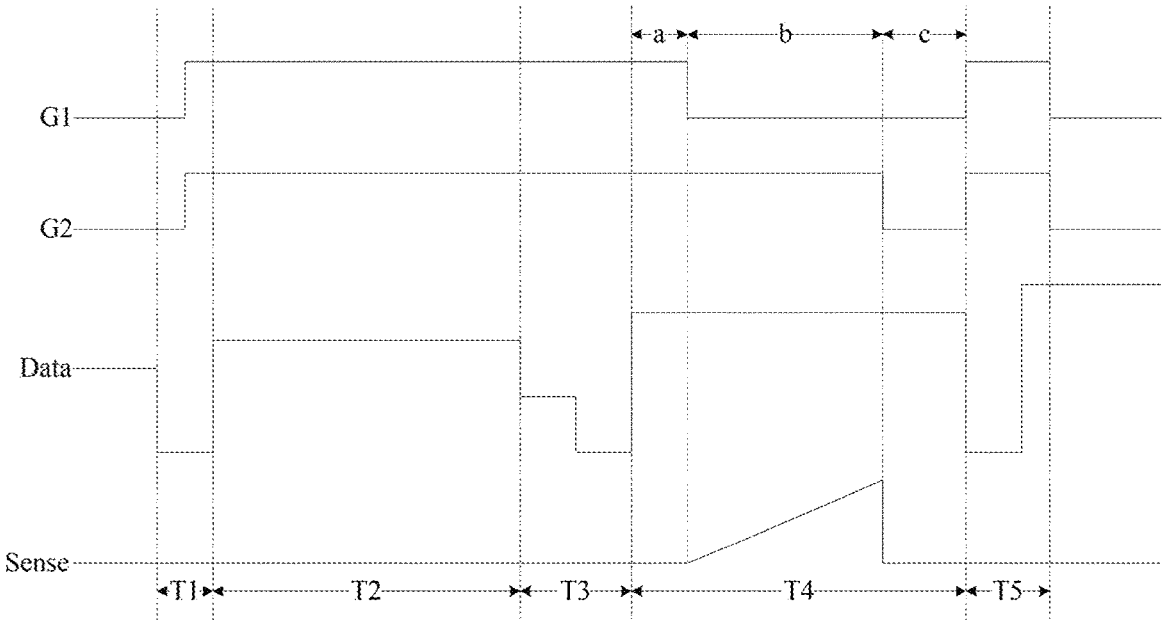
Figure 5C:
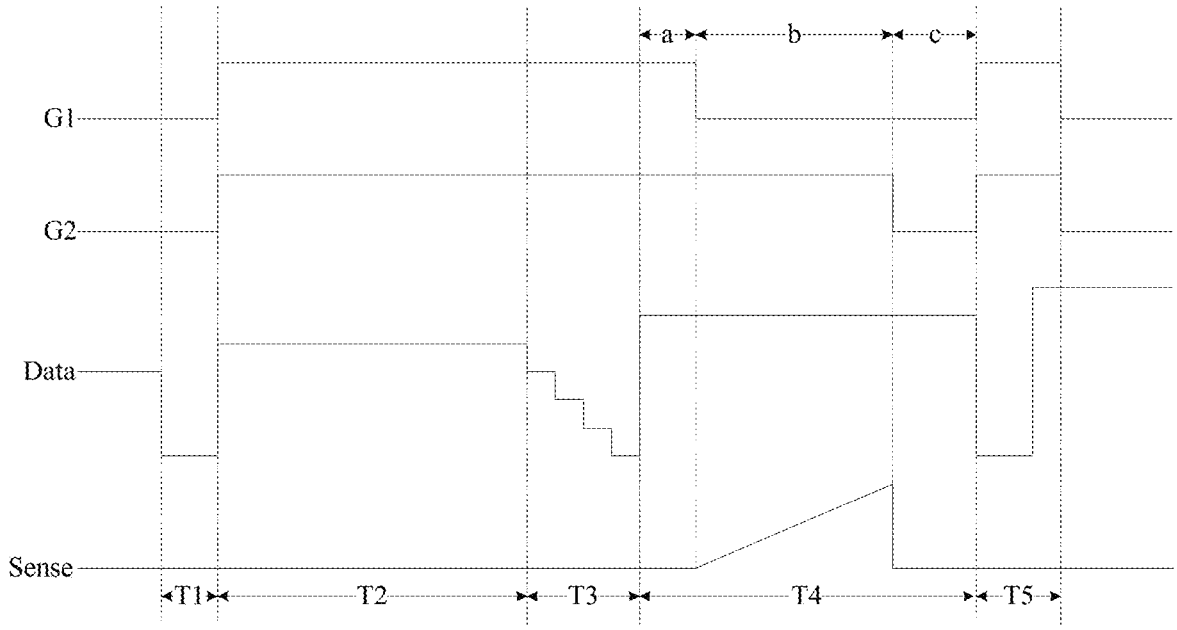
Figure 5D:
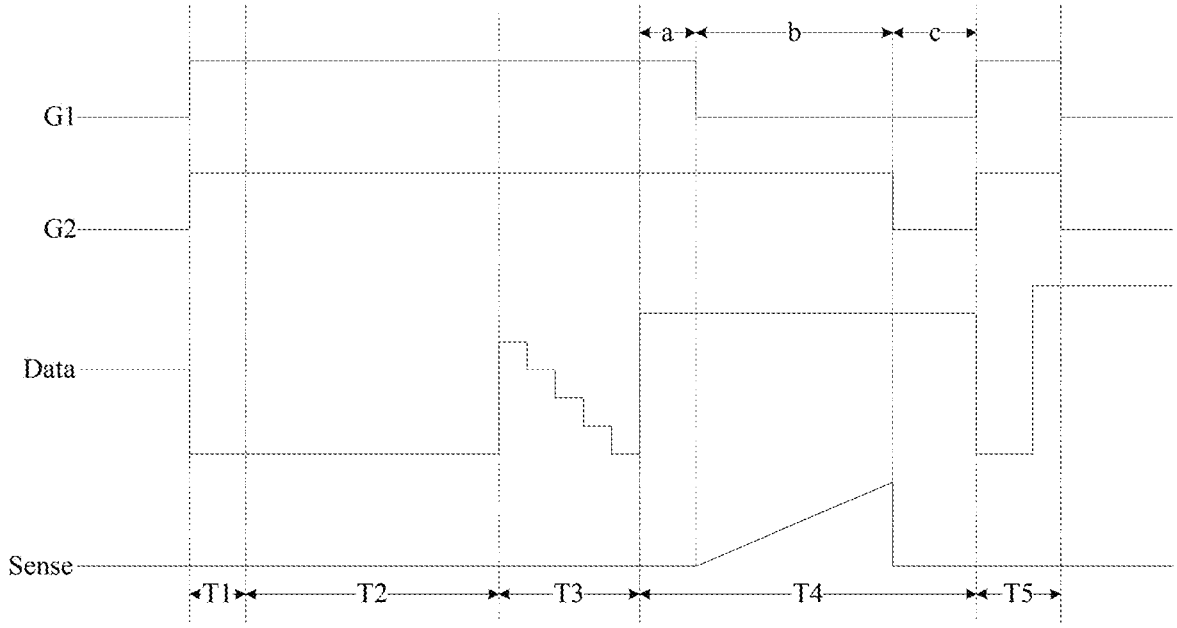

In the first manner, as shown in FIGS. 5A and 5D, from the start of the first period of time T1, the first ON signal is provided to the first scan signal terminal and the second ON signal is provided to the second scan signal terminal. Thus, simultaneously, the first ON signal is provided to the first scan signal terminal G1, the second ON signal is provided to the second scan signal terminal G2, and the zero-voltage signal is provided to the data signal terminal Data. That is, corresponding signals are provided to the three terminals simultaneously, i.e., the corresponding signals are provided to the three terminals at the same start moment. Therefore, it may ensure that the data signal terminal Data is at a zero voltage at the moment when the first transistor M1 and the second transistor M2 are switched from OFF to ON, thereby ensuring the OFF state of the drive transistor DTFT at this moment.

Figure 5E:
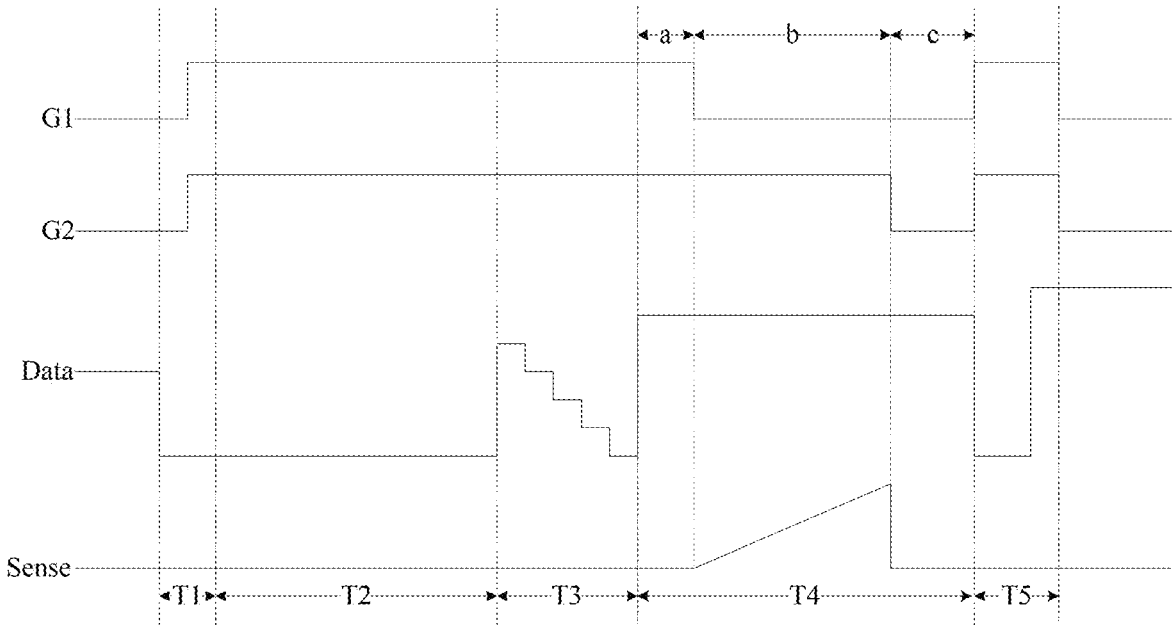

In the second manner, as shown in FIGS. 5B and 5E, from a certain moment of the first period of time T1, the first ON signal is provided to the first scan signal terminal and the second ON signal is provided to the second scan signal terminal. Thus, the first ON signal is provided to the first scan signal terminal G1 and the second ON signal is provided to the second scan signal terminal G2 after the zero-voltage signal is provided to the data signal terminal Data. That is, the zero-voltage signal is first provided to the data signal terminal Data, and corresponding ON signals are provided to the first scan signal terminal G1 and the second scan signal terminal G2 in the process of maintaining the zero-voltage signal at the data signal terminal Data. Therefore, it may ensure that the data signal terminal Data has already been at the zero voltage at the instant when the first transistor M1 and the second transistor M2 are switched from OFF to ON, thereby ensuring the OFF state of the drive transistor DTFT at this moment.

Figure 5F:
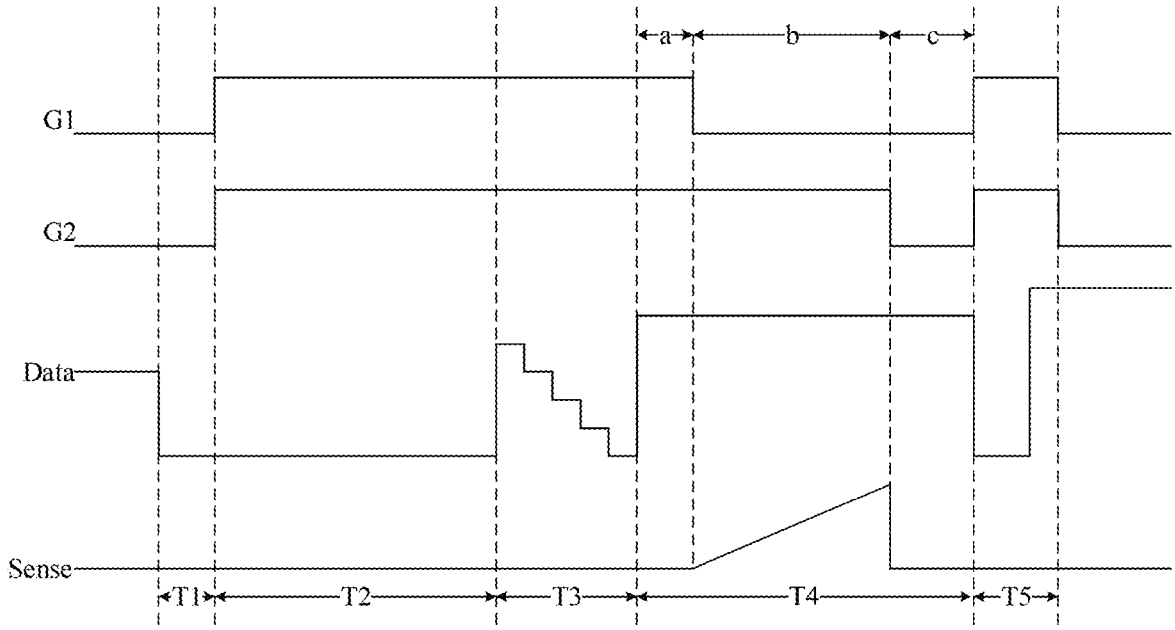

In the third manner, as shown in FIGS. 5C and 5F, in the first period of time T1, an OFF signal is provided to the first scan signal terminal, and an OFF signal is provided to the second scan signal terminal. Thus, upon the completion of providing the zero-voltage signal to the data signal terminal Data, the first ON signal is provided to the first scan signal terminal G1 and the second ON signal is provided to the second scan signal terminal G2 simultaneously. That is, when a signal changed from the zero-voltage signal to a next-stage signal is provided to the data signal terminal Data, corresponding ON signals are provided to the first scan signal terminal G1 and the second scan signal terminal G2. Therefore, it may ensure that the data signal terminal Data is still at the zero voltage at the moment when the first transistor M1 and the second transistor M2 are switched from OFF to ON, thereby ensuring the OFF state of the drive transistor DTFT at this moment.

In some embodiments of the present disclosure, the second period of time T2 functions to eliminate the hysteresis effect of the drive transistor in the process from an OFF state to an ON state using a biasing algorithm. Specifically, the first transistor M1 remains in the ON state when the first ON signal is maintained at the first scan signal terminal G1. The second transistor M2 remains in the ON state when the second ON signal is maintained at the second scan signal terminal G2. The first level data signal or the zero-voltage signal is provided to the data signal terminal Data to eliminate the hysteresis effect of the drive transistor DTFT in the process from OFF to ON using a biasing algorithm. In addition, the duration of the second period of time T2 should be extended as much as possible to facilitate eliminating the hysteresis effect of the drive transistor.

In addition, in some embodiments of the present disclosure, in the second period of time T2, the hysteresis effect may be eliminated using the biasing algorithm in the state when the drive transistor DTFT is ON. As shown in FIGS. 5A-5C, the first level data signal provided to the data signal terminal Data is a non-zero data signal. That is, the drive transistor DTFT is maintained ON for the duration of the second period of time to stabilize the state of the drive transistor DTFT.

Alternatively, in some embodiments of the present disclosure, in the second period of time T2, the hysteresis effect may be eliminated using the biasing algorithm in the state when the drive transistor DTFT is OFF. As shown in FIGS. 5D-5F, the zero-voltage signal is provided to the data signal terminal Data. That is, the drive transistor DTFT is maintained OFF for the duration of the second period of time to stabilize the state of the drive transistor DTFT.

In some embodiments of the present disclosure, the third period of time T3 functions to eliminate effects of factors such as data coupling. Specifically, the first transistor M1 remains in the ON state when the first ON signal is maintained at the first scan signal terminal G1. The second transistor M2 remains in the ON state when the second ON signal is maintained at the second scan signal terminal G2. The effects of the data coupling or the like may be gradually eliminated by providing a decreased data signal to the data signal terminal Data.

Specifically, in order to facilitate eliminating the effects of the data coupling or the like gradually, as shown in FIGS. 5A-5F, the decreased data signal provided to the data signal terminal Data may be a stepped-down data signal. Moreover, other signal forms may also be used, which is not limited herein.

Further, as shown in FIGS. 5A-5F, in the third period of time T3, the stepped-down data signal may be a four-stage stepped-down data signal to facilitate in decreasing the amplitude for the decreased data signal from the first level data signal, for example, decreasing to zero voltage.

In some embodiments of the present disclosure, the function of the fourth period of time T4 is to acquire the compensation data. Specifically, the fourth period of time T4 may be sequentially divided into a first sub-period of time a, a second sub-period of time b, and a third sub-period of time c.

In the first sub-period of time a, the first ON signal is maintained at the first scan signal terminal G1 to maintain the ON state of the first transistor M1. The second ON signal is maintained at the second scan signal terminal G2 to maintain the ON state of the second transistor M2. The second level data signal is provided to the data signal terminal Data. According to the compensation calculation formula $I=K(Vgs-Vth)^2$, Vgs of the drive transistor DTFT at this moment is $Vgs=Vdata+Vth$, i.e., $I=K\times Vdata^2$.

In the second sub-period of time b, an OFF signal is provided to the first scan signal terminal G1 to disable the first transistor M1, and the current of the drive transistor DTFT is maintained stably at $Vgs-Vth=Vdata$. The second ON signal is maintained at the second scan signal terminal G2, and the second level data signal is maintained at the data signal terminal Data to charge the sense signal terminal Sense.

In the third sub-period of time c, an OFF signal is maintained at the first scan signal terminal G1 to maintain the OFF state of the first transistor M1. An OFF signal is provided to the second scan signal terminal G2 to disable the second transistor M2. The second level data signal is maintained at the data signal terminal Data to obtain the compensation data for the sense signal terminal Sense. Specifically, the compensation data for the sense signal terminal Sense may be obtained through an ADC.

In some embodiments of the present disclosure, value of the second level data signal provided to the data signal terminal Data in the fourth period of time T4 is generally greater than value of the first level data signal provided in the second period of time T2, such that effectiveness of eliminating the effects of the factors such as data coupling completed in the third period of time T3 can be maintained.

In some embodiments of the present disclosure, the fifth period of time T5 functions to eliminate scan dark lines. Specifically, the first transistor M1 is switched from OFF to ON when the first ON signal is provided to the first scan signal terminal G1. The second transistor M2 is switched from OFF to ON when the second ON signal is provided to the second scan signal terminal G2. The zero-voltage signal is provided to the data signal terminal Data, and then a gain data signal can be provided to the data signal terminal Data, to write gain data back to the gate of the drive transistor. Therefore, it prevents the voltage difference of the gate of the drive transistor DTFT between the blank period of time and subsequent light emission period of time from changing too much.

Specifically, the gain data signal provided to the data signal terminal may be related to the compensation data obtained in the fourth period of time. For example, the gain data signal may be obtained by multiplying the compensation data by a preset coefficient. The gain data signal may be written into the data signal terminal Data.

In some embodiments of the present disclosure, the first period of time T1 accounts for 3% of the blank period of time, the second period of time T2 accounts for 10% of the blank period of time, the third period of time T3 accounts for 5% of the blank period of time, the fourth period of time T4 accounts for 79% of the blank period of time, and the fifth period of time T5 accounts for 3% of the blank period of time.

It is to be noted that, in the above driving method provided by the embodiments of the present disclosure, in the blank period of time, the sense signal terminal Sense is provided with the zero-voltage signal except for the second sub-period of time of the fourth period of time. In this way, it may ensure that when the second transistor M2 is in the ON state, one end of the organic light emitting diode (OLED) is electrically connected to the sense signal terminal Sense. Therefore, it ensures that no current will flow into the OLED, such that the OLED will not emit light. Thereafter, in the light emission period of time, the first ON signal is provided to the first scan signal terminal G1, such that the first transistor M1 is in the ON state. The OFF signal is provided to the second scan signal terminal G2, such that the second transistor M2 is in the OFF state. The data signal compensated by the compensation data obtained in the fourth period of time T4 of the previous frame is provided to the data signal terminal Data to control the organic light emitting diode (OLED).

The embodiments of the present disclosure also provide a display panel, which includes the above pixel circuit. The display panel may be any product or component having a display function, such as a mobile phone, a tablet computer, a TV set, a display, a notebook computer, a digital photo frame, a navigation device and so on. Reference may be made to the embodiments of the above pixel circuit for the implementation of the display panel, and what is repeated is omitted herein.

According to the above embodiments, those skilled in the art may understand that the embodiments of the present disclosure can be implemented by hardware or by software in conjunction with necessary common hardware platform. Based on such understanding, the technical solutions according to the embodiments of the present disclosure may be embodied in a form of a software product which may be stored on a nonvolatile storage medium (which may be CD-ROM, flash memory, mobile hard disk and the like), including a number of instructions for enabling a computer device (which may be a personal computer, a server, or a network device and the like) to perform the method according to the embodiments of the present disclosure.

Persons skilled in the art may understand that the drawings are merely schematic diagrams of an embodiment, and modules or flows in the drawing are not necessarily for implementing the present disclosure.

Those skilled in the art may understand that modules in the device in the embodiments may be distributed in the devices according to description of the embodiment, or may be correspondingly changed and positioned in one or more devices different from the embodiment. The modules of the above-described embodiments may be combined into one module or may be further divided into a plurality of sub-modules.

The serial numbers of the above embodiments of the present disclosure are merely illustrated for description, and do not represent superiorities or inferiorities of the embodiments.

The embodiments of the present disclosure provide a method for driving a pixel circuit, a pixel circuit, and a display panel. In this method, in the blank period of time, in order to eliminate the effect of parasitic capacitance on the gate voltage of the drive transistor at the moment when the first transistor and the second transistor are enabled, the zero-voltage signal can be first provided to the data signal terminal. Then, the first level data signal of a certain duration or the zero-voltage signal can be provided to the data signal terminal to eliminate the hysteresis effect of the drive transistor in the process from the OFF state to the ON state using a biasing algorithm. Next, the decreased data signal can be provided to the data signal terminal to eliminate the effects of factors such as data coupling. Next, in the process of acquiring the compensation data, the second level data signal can be maintained at the data signal terminal, the sense signal terminal can be charged after the first transistor is disabled, and then the compensation data for the sense signal terminal can be acquired. After that, the gain data signal can be provided to the data signal terminal to eliminate the scan dark lines, thereby solving the problem of leaving horizontal stripes when pictures are switched.

Obviously, those skilled in the art may alter or modify the present disclosure without departing from the spirit and scope of the present disclosure. Thus, if these alterations and modifications of the present disclosure fall within the scope of claims of the present disclosure and equivalent technologies thereof, the present disclosure is intended to cover these alterations and modifications.

What is claimed is:

1. A method for driving a pixel circuit, the method comprising:

providing a zero-voltage signal to a data signal terminal of the pixel circuit in a first period of time;

providing a first ON signal to a first scan signal terminal of the pixel circuit, providing a second ON signal to a second scan signal terminal of the pixel circuit, and providing a first level data signal or the zero-voltage signal to the data signal terminal in a second period of time;

maintaining the first ON signal at the first scan signal terminal, maintaining the second ON signal at the second scan signal terminal, and providing to the data signal terminal a decreased data signal decreased from the first level data signal in a third period of time;

providing a second level data signal to the data signal terminal in a fourth period of time, wherein the fourth period of time comprises a first sub-period of time, a second sub-period of time, and a third sub-period of time, and wherein:

in the first sub-period of time, the first ON signal is provided to the first scan signal terminal, the second ON signal is provided to the second scan signal terminal, and the second level data signal is provided to the data signal terminal;

in the second sub-period of time, the OFF signal is provided to the first scan signal terminal, the second ON signal is provided to the second scan signal terminal, and the second level data signal is provided to the data signal terminal to charge a sense signal terminal of the pixel circuit; and in the third sub-period of time, the OFF signal is maintained at the first scan signal terminal, the OFF signal is provided to the second scan signal terminal, and the second level data signal is provided to the data signal terminal, to obtain the compensation data for the sense signal terminal; and providing the zero-voltage signal to the data signal terminal in a fifth period of time.

2. The method according to claim 1, wherein in the first period of time, the first ON signal is provided to the first scan signal terminal, and the second ON signal is provided to the second scan signal terminal.

3. The method according to claim 2, wherein in the first period of time, the first ON signal is provided to the first scan signal terminal and the second ON signal is provided to the second scan signal terminal when or after the zero-voltage signal is provided to the data signal terminal of the pixel circuit.

4. The method according to claim 1, wherein in the first period of time, an OFF signal is provided to the first scan signal terminal, and an OFF signal is provided to the second scan signal terminal.

5. The method according to claim 1, wherein a value of the first level data signal is less than a value of the second level data signal.

6. The method according to claim 1, wherein the decreased data signal is a stepped-down data signal.

7. The method according to claim 6, wherein the stepped-down data signal is a four-stage stepped-down data signal.

8. The method according to claim 1, wherein in the fifth period of time, the first ON signal is provided to the first scan signal terminal, the second ON signal is provided to the second scan signal terminal, and a gain data signal is provided after the zero-voltage signal is provided to the data signal terminal.

9. The method according to claim 8, wherein the gain data signal is obtained by multiplying the compensation data by a preset coefficient.

10. The method according to claim 1 further comprising:

in a light emission period of time, providing the first ON signal to the first scan signal terminal, providing the OFF signal to the second scan signal terminal, and providing a compensated data signal to the data signal terminal.

11. The method according to claim 1, wherein the first period of time, the second period of time, the third period of time, the fourth period of time, and the fifth period of time constitute a blank period of time, and wherein:

the first period of time accounts for 3% of a duration of the blank period of time, the second period of time accounts for 10% of the duration of the blank period of time, the third period of time accounts for 5% of the duration of the blank period of time, the fourth period of time accounts for 79% of the duration of the blank period of time, and the fifth period of time accounts for 3% of the duration of the blank period of time.

12. A pixel circuit driven by the method according to claim 1, the pixel circuit comprising a drive transistor, a first transistor, a second transistor, a capacitor, and a light emitting device;

wherein a gate of the first transistor is coupled to the first scan signal terminal, wherein a first electrode of the first transistor is coupled to the data signal terminal, and wherein a second electrode of the first transistor is coupled to a gate of the drive transistor;

wherein a gate of the second transistor is coupled to the second scan signal terminal, wherein a first electrode of the second transistor is coupled to the sense signal terminal, and wherein a second electrode of the second transistor is coupled to a first node;

wherein a first electrode of the drive transistor is coupled to a high potential signal terminal, and wherein a second electrode of the drive transistor is coupled to the first node;

wherein an end of the light emitting device is coupled to the first node, and wherein another end of the light emitting device is grounded; and wherein the capacitor is coupled between the first node and the gate of the drive transistor.

13. The pixel circuit according to claim 12, wherein the first transistor is an N-type transistor, and the first ON signal is a high voltage signal; or the first transistor is a P-type transistor, and the first ON signal is a low voltage signal.

14. The pixel circuit according to claim 13, wherein the second transistor is an N-type transistor, and the second ON signal is a high voltage signal; or the second transistor is a P-type transistor, and the second ON signal is a low voltage signal.

15. A display panel comprising the pixel circuit according to claim 12.

* * * * *